US008186072B1

(12) United States Patent
Nethery

(10) Patent No.: US 8,186,072 B1
(45) Date of Patent: May 29, 2012

(54) QUILTING TEMPLATES

(76) Inventor: Patti L. Nethery, Conroe, TX (US)

( * ) Notice: Subject to any disclaimer, the term of this patent is extended or adjusted under 35 U.S.C. 154(b) by 14 days.

(21) Appl. No.: 12/985,735

(22) Filed: Jan. 6, 2011

(51) Int. Cl.
*B43L 13/20* (2006.01)

(52) U.S. Cl. ..... 33/565; 33/563; 33/11

(58) Field of Classification Search ..... 33/11, 12, 33/13, 563, 565, 566
See application file for complete search history.

(56) References Cited

U.S. PATENT DOCUMENTS

| | | | | |
|---|---|---|---|---|
| 1,047,823 | A * | 12/1912 | Marsden | 33/12 |
| 1,538,718 | A * | 5/1925 | Mehlem | 283/115 |
| 3,037,293 | A * | 6/1962 | Yost | 33/565 |
| 3,857,184 | A * | 12/1974 | Burkin et al. | 33/563 |
| 4,937,949 | A * | 7/1990 | Kiefer | 33/563 |
| 5,791,062 | A | 8/1998 | Walker | |
| 6,155,189 | A | 12/2000 | Walner | |
| 6,321,458 | B1 | 11/2001 | Hess | |
| 7,448,142 | B2 * | 11/2008 | Geier | 33/566 |
| 7,703,214 | B2 | 4/2010 | Platt | |
| 7,730,842 | B1 | 6/2010 | Sebrow | |
| 7,770,303 | B2 | 8/2010 | Graham et al. | |
| 2006/0191150 | A1 * | 8/2006 | Sikora et al. | 33/566 |
| 2010/0223798 | A1 * | 9/2010 | Zimmerman | 33/563 |
| 2011/0048186 | A1 * | 3/2011 | Thomas et al. | 33/566 |

OTHER PUBLICATIONS

"Connecting Threads" p. 56, Oct. 2010.
"Clover USA Trace 'n Create Quilt Templates (Dresden Plate & Fan Collection)".
"Snowball Blocks", www.straw.com, pp. 1-8; 2001.
"Half-Square Triangle Stencil Demonstration." Sunday's Best Quiltworks. p. 1-6.
"Magic Base Blocks." p. 12-14. That Patchwork Place, Inc., 1996.
"Quilting Rulers, Quilting Templates, Quilting Sewing Rulers.." Ginger's Needleworks & Quilting, 13 pages, www.quiltknit.com.

* cited by examiner

*Primary Examiner* — G. Bradley Bennett
(74) *Attorney, Agent, or Firm* — John J. Love; Claude E. Cooke, Jr.; Cooke Law Firm

(57) ABSTRACT

A plurality of templates include cutting and sewing lines for forming a plurality of various pieces of two coordinating fabrics for use in quilt making. The template is made of a relatively rigid sheet of transparent or semi-transparent material such as acrylic. The cutting and sewing lines are formed by a plurality of spaced openings extending through the sheet material.

9 Claims, 4 Drawing Sheets

QUILTING TEMPLATES

This application is related to Applicant's co-pending U.S. application Ser. No. 12/915,378 filed on Oct. 29, 2010.

BACKGROUND OF INVENTION

1. Field of the Invention

This invention is directed to templates that are used by quilters to mark fabric for sewing and cutting in order to form a plurality of fabric pieces that are ultimately sewn together to create a quilt pattern.

2. Description of Related Art

Templates are available that assist quilters in creating certain types of patterns for quilt. However several are designed for making only the pattern one at a time and involve substantial waste. Many templates are made of very thin, flexible material that makes it difficult to line up with other markings or the fabric. They typically do not allow for a continuous stitch line without the need for cutting the thread.

BRIEF SUMMARY OF THE INVENTION

The present invention allows for the making of a plurality of fabric pieces in a very short time period and with little waste material.

Templates used for making stick and stone type patterns, middle split diamonds, length wise split diamonds, and maple leaf patterns are included in the disclosure. The templates allow the quilter to trace out cut lines and sewing lines on a two ply sheet of fabric to create a plurality of distinct pieces of the type mentioned in a highly efficient manner.

BRIEF DESCRIPTION OF THE SEVERAL VIEWS OF THE DRAWING(S)

DETAILED DESCRIPTION OF THE INVENTION

Figures 1, 2:
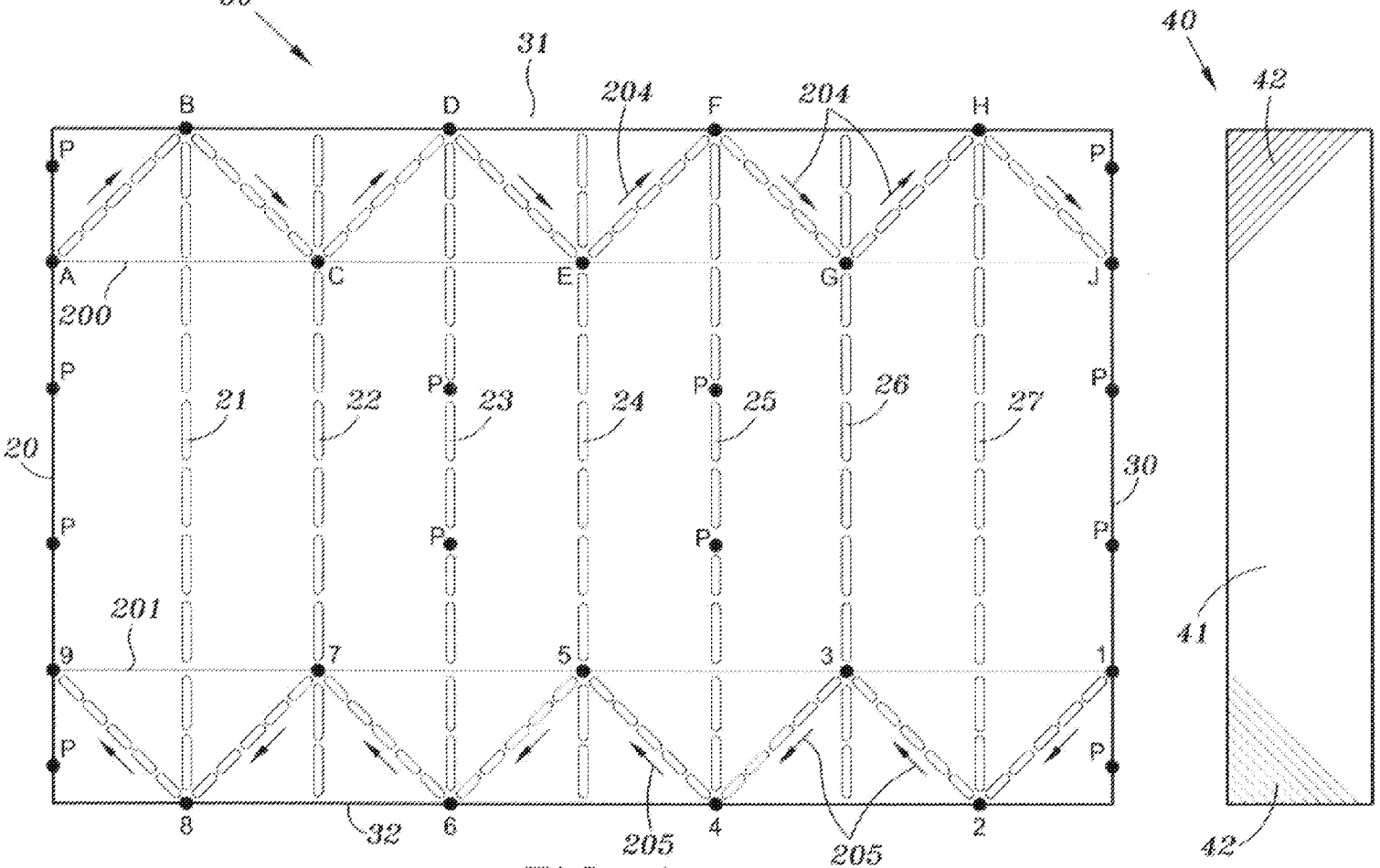
FIG. 1 is a top view of a template for use in formulating stick and stone types of patterns.
FIG. 2 is a top view of the stick and stone piece of fabric formed by using the template of FIG. 1.

An embodiment of the template and ruler of the invention is shown in FIG. 1. The template/ruler of FIG. 1 is designed to produce a plurality of sticks and stones one of which is shown in FIG. 2.

The template is formed for example by a 12 in. by 7 in. piece of transparent or translucent plastic such as acrylic which may include a non-slip surface. The template may be from about 1/16" to a 3/16" thick and is relatively rigid. A plurality of straight spaced apart openings are formed through the thickness of the template to allow for indicating sewing and cutting lines as described below. The template includes vertical cutting lines 21-27. A plurality of sewing lines are also indicated by a plurality of spaced openings along points AB, BC, CD, DE, EF, FG, GH, HJ, and from lines 1-2, 2-3, 3-4, 4-5, 5-6, 6-7, 7-8, and 8-9. The sewing and cutting openings may be of different lengths or spacing to distinguish between them in all the embodiments described.

A plurality of individual pieces are formed in the following manner. Two coordinating pieces 13" by 13" for example of quilting fabric are selected. One fabric is referred to as the stick fabric and will constitute the portion of the piece indicated at 41 in FIG. 2. The second fabric will be referred to as stone fabric and will constitute the portion of the finished piece indicated at 42 in FIG. 2. A top straight line 200 extends from point A to point J and outlines a plurality of squares 204 together with top edge 31 and vertical cut lines 21-27. A bottom straight line 201 extends from point 9 to point 1 and also forms a plurality of squares 205. Sew lines A, B . . . and 1, 2 . . . are diagonal lines within the squares.

The stone fabric is cut into two pieces that are 13" by 2" each. Other dimensions may be chosen. The stick fabric is placed face down on a cutting mat and the template is placed on the fabric. The quilter then marks the cutting and sewing lines as well as the outside perimeter of the template. Next one of the stone pieces of fabric is placed under the top of the stick fabric with the 13" length portion lined up. The pieces are pinned together. The same procedure is followed with the second stone piece along the bottom of the stick piece. Now the two pieces of fabric are sewn along sew lines AB through HJ and from sew lines 1-2 through 8-9 without cutting the thread. The two ply fabric can now by placed on the cutting mat and the assembly is cut along vertical cut lines 21-27. The stone fabric is then folded back over the sewing line to form a triangle and pressed in place. The two layers of stone and stick fabrics on the other side of the fold line are cut away and then folded over portion of the stone fabric is trimmed to match the stick fabric. The same trimming procedure is repeated for each of the eight sticks.

Figure 3:
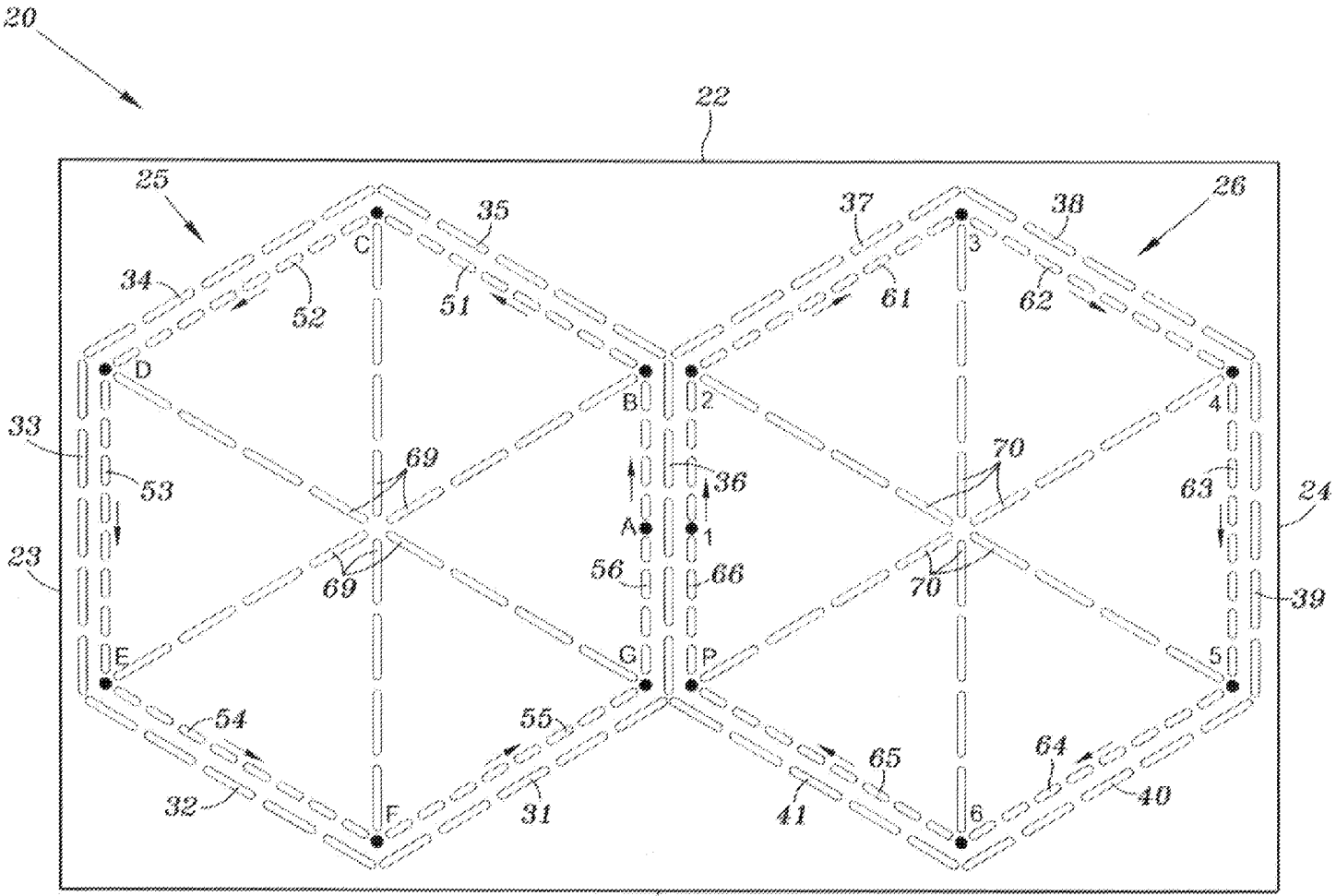
FIG. 3 is a perspective view of a template used in formulating middle split diamonds.

FIG. 3 illustrates an embodiment of the invention used for forming a plurality of middle split diamonds. The template includes a generally rectangular sheet of transparent or translucent plastic such as acrylic which may have a non-slip surface. The rectangular sheet has a top portion 22, bottom portion 21, a left side portion 23, and a right side portion 24.

A plurality of spaced apart openings form cut lines and sewing lines as in the previous embodiment. A plurality of perimeter cut lines 31-36 form a hexagon 34 on the left side of the template and a plurality of perimeter cut lines 36-41 form a second hexagon 26 on the right side of the template. The hexagons have a common side 36. A plurality of sewing lines are spaced inwardly of the cut lines indicated at 51-56 for the left side hexagon and at 61-66 on the right side hexagon. The spacing may be about 1/4" for example. Each hexagon also includes a plurality of cut lines 69, 70 extending from the center of the hexagon to point at the intersection of the sew lines as seen in FIG. 3.

Figure 4:
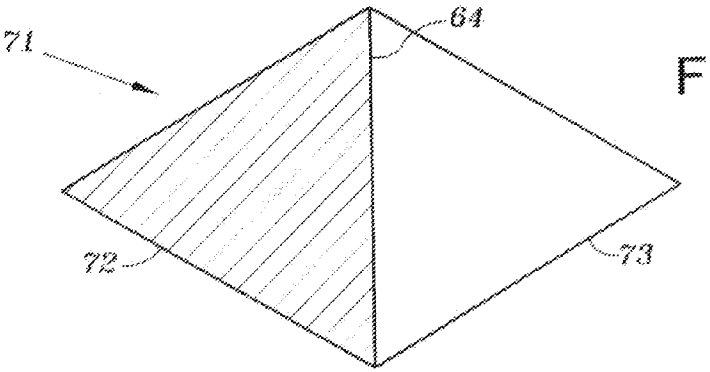
FIG. 4 is a top view of a middle split diamond formed by using the template of FIG. 3.

A plurality of middle split diamonds can be forming in the following manner as an example. Two co-coordinating pieces of quilting fabric slight larger than the template are stacked together with right sides together. The template is now placed on the wrong side of the top fabric and sewing lines and cutting lines are traced on the template using different color marking devices to distinguish between cutting and sewing lines. Next the pieces are pinned together and the fabric is placed under the needle of a sewing machine with point A under the needle and point B between point A and the sewer. A continuous stitch is now formed by sewing along points A, B, C, D, E, F, G, and back to A. Without cutting the thread at A, the needle is raised and moved over to point 1 on the perimeter of the right side hexagon. A continuous stitch is then formed by sewing along lines 61, 62, 63, 64, 65, and back to point 1 on sew line 66. The next step is to place the sewn fabric on a cutting mat and cut along cutting line 36 to separate the two hexagons followed by cutting along the outside cutting lines 31-35 for the left hexagon and lines 37-41 for the right side hexagon. Finally the layered fabric is now cut along lines 69 and 70 to form a total of twelve perfectly sized diamonds 71 one of which is shown in FIG. 4. Half of the diamond will be formed of one of the fabrics 72 and the other half will consist of the second chosen fabric 73. In lieu of a hexagon, the template could be formed as two octagons which result in sixteen 45 degree slit diamonds.

Figure 5:
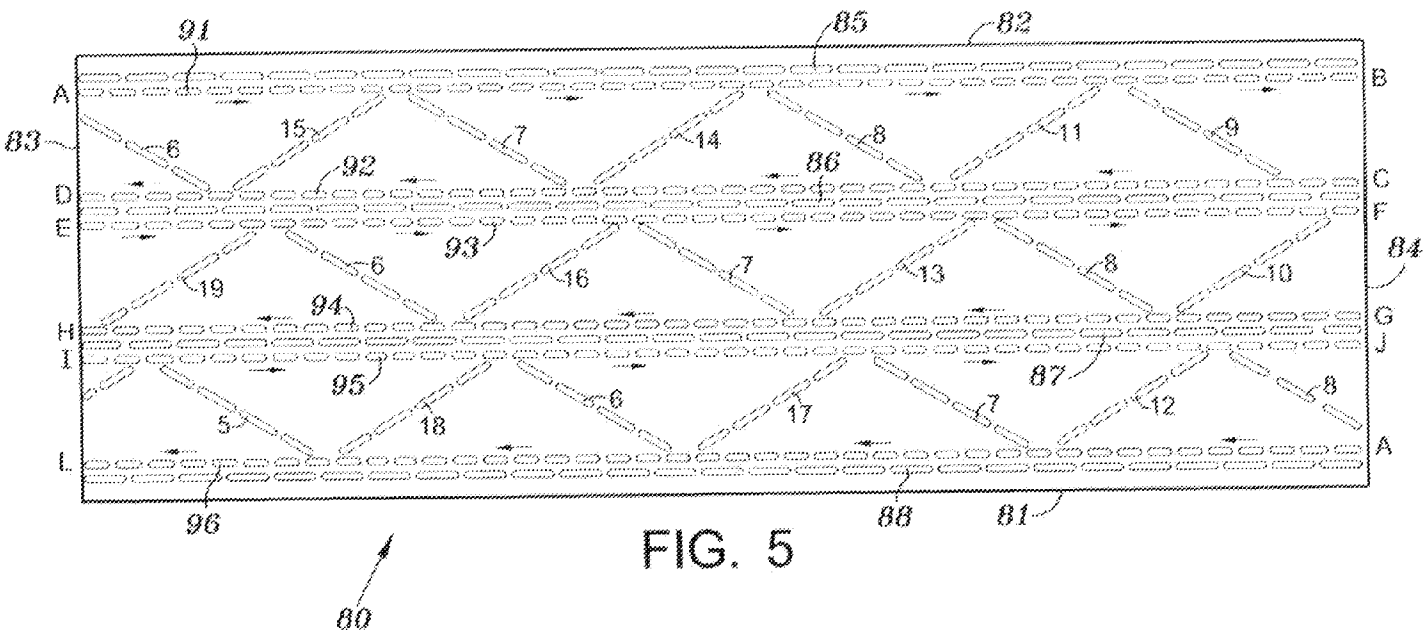
FIG. 5 is a perspective view of a template used in formulating length wise split diamonds.

Another embodiment of the invention is illustrated in FIG. 5. This template is used to form length wise split diamonds.

The template 80 is in the general form of a rectangle with a top portion 82, a bottom edge 81 and side edges 83 and 84. The template is formed from a transparent or translucent material such as acrylic which may include a non-slip surface. Once again sewing and cutting lines are formed by a plurality of spaced apart openings extending through the template which can be used to trace lines on the fabric by using a suitable marking device such as a pencil. In this embodiment, the cutting lines are 5-19 and 85, 86, 87, and 88. Sewing lines are at 91, 92, 93, 94 95, and 96. The sewing lines extend from side edge 83 to side edge 84. Cutting lines 6, 7, and 8 extend between sewing lines 91 and 96.

The procedure for forming the length wise split diamonds is as follows. Two pieces of co-coordinating quilting fabric are selected and cut to be slightly larger than the template. The pieces are stacked right side together and the template is placed on the wrong side of the top fabric. The cutting and sewing lines and then traced onto the fabric and may be color coded. The fabric is then pinned together and placed beneath the needle at point A with point B between point A and the sewer. A continuous stitch can now be formed by sewing from points A, B, C, D, E, F, G, H, I, J, K, to L while turning the fabric accordingly. Next the layered fabric is placed on a cutting mat and using the template the fabric is cut along cutting lines 85, 86, 87, and 88. Finally cuts can be made along the diagonal cutting lines in any convenient order, preferably along the lines 5, 6, 7 . . . through 19. The result will be 18 precision lengthwise split diamonds.

Figure 6:
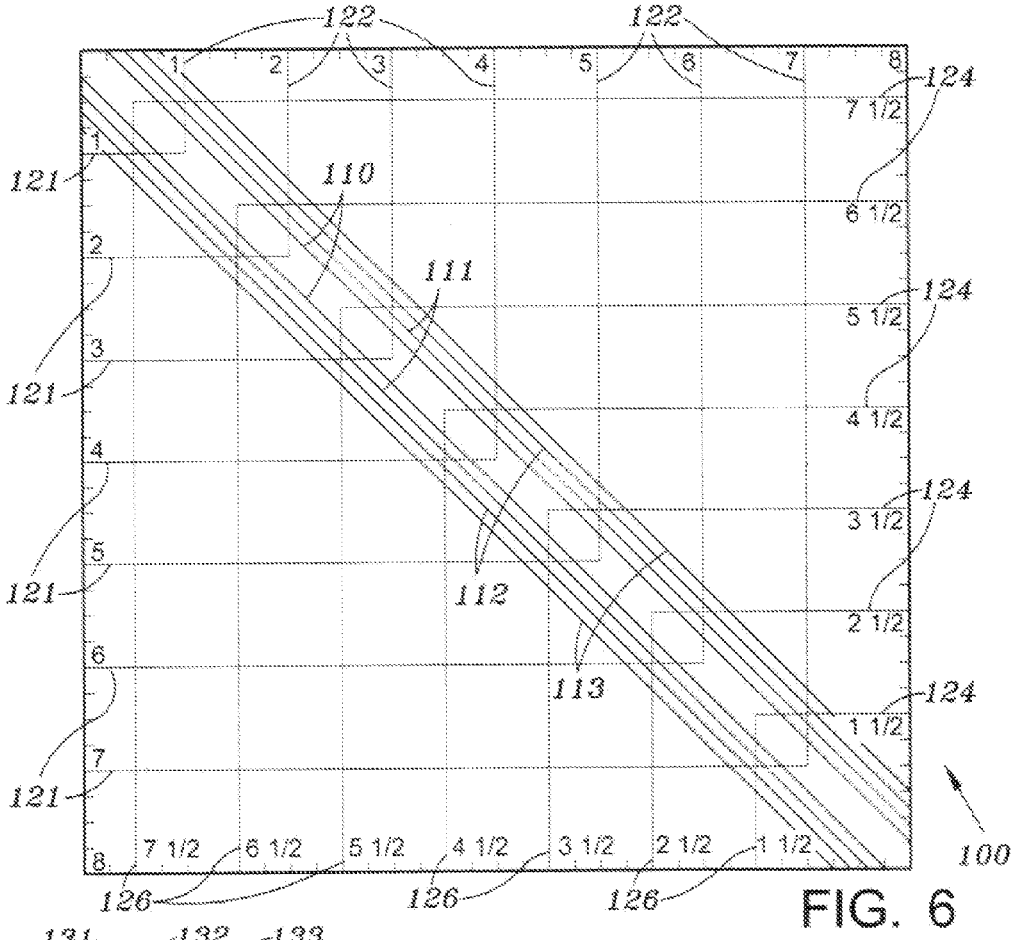
FIG. 6 is a top view of a template for formulating maple leaf patterns.

FIG. 6 illustrates a further embodiment of the invention useful for forming maple leaf stem blocks. As in previous embodiments, the maple leaf stem template 100 is a flat sheet of rigid transparent or translucent material which may include a non-stick surface. For explanation purposes, the template is an 8 inch square. Four pairs of parallel lines extend diagonally across the square as shown at 110, 111, 112, and 113. The width between the lines will correspond to the width of the stem portion of the maple stem block. The template further includes a first set of horizontal lines 121 that intersects with a second set of vertical lines 122 that together with the outer edges of the template form a plurality of squares that range from 1 to eight inches. The template also includes a third set of horizontal lines 124 that intersect with a fourth set of vertical lines 126 that form together with the periphery of the template a second set of squares ranging from 1½ inch to 7½ inch.

Figure 9:
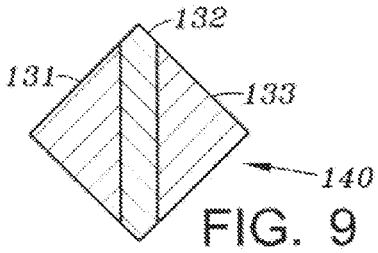
FIG. 9 is a top view of the finished maple stem block.

The use of the template will now be described. First the user determines the desired width of the finished stem block and divides that number in half. The user then selects two coordinating pieces of fabric and spray starches them until they are stiff. Next cut two strips of one of the coordinating pieces to the thickness described above plus one half inch. Cut the other coordinating fabric to the desired width of the stem plus one half inch. With right sides together the stem fabric is sewn to one of the wider pieces of material with about a quarter inch seam. Now the seam is pressed to the middle. Next the other wide strip is sewn to the other side of the stem fabric again with about a quarter each seam. The seam is pressed to the center. Starting at one end of the sewn strip, place the maple leaf stem ruler on the strip lining up the stem width strips with the stem on the fabric. Now using the edge of the template cut off the right angle at the end of the strip. Next the template is turned around to line up the correct finish square size with the just cut edges. Once they are lined up, the last two edges are cut creating the maple stem block with the stem centered in the diagonal in the square as shown in FIG. 9. As with all embodiments the template may be made from frosted acrylic to prevent slipping on the fabric.

Figure 7:
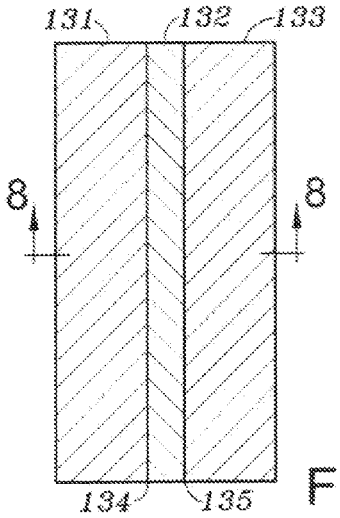
FIG. 7 is a top view of two coordinating fabrics sewn together for use with the template of FIG. 6.
Figure 8:
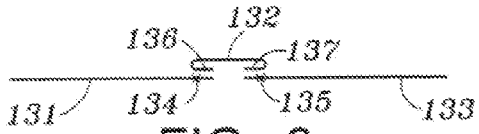
FIG. 8 is a cross section view taken along line 8-8 of FIG. 7.

FIG. 7 is a top view of the two coordinating fabrics sewn together. Two strips of the first coordinating material 131 and 133 are sewn to the second coordinating material 132. FIG. 8 shows cross-sectional view of the coordinating fabrics sewn together before the composite is cut into a finished maple stem block. The top coordinating material is sewn at 134 and 135 to side coordinating material 131 and 133. Two portions of the top coordinating material 136 and 137 are folded at seam 134 and 135 back under the top portion 132.

Although the present invention has been described with respect to specific details, it is not intended that such details should be regarded as limitations on the scope of the invention, except to the extent that they are included in the accompanying claims.

It is understood that modifications to the invention may be made as might occur to one skilled in the field of the invention within the scope of the appended claims. All embodiments contemplated hereunder which achieve the objects of the invention have not been shown in complete detail. Other embodiments may be developed without departing from the spirit of the invention or from the scope of the appended claims. Although the present invention has been described with respect to specific details, it is not intended that such details should be regarded as limitations on the scope of the invention, except to the extent that they are included in the accompanying claims.

I claim:

1. A cutting and marking template for forming a plurality of stick and stone quilting pieces comprising:

a generally flat sheet of transparent or semi-transparent material having a top portion a bottom portion, and two side portions, a plurality of straight vertical cut lines extending between the top and bottom of the flat sheet, the lines formed by a plurality of spaced openings extending through the sheet, a top line marked on the template which outlines a plurality of squares together with the top portion and the vertical lines; and a plurality of sewing lines formed by the diagonal lines of the squares, the sewing lines being formed by a plurality of spaced openings extending through the sheet.

2. The cutting and marking template of claim 1 further including a bottom line marked on the template and forming a plurality of squares together with the vertical cutting lines and the bottom edge of the template; and a second set of sewing lines formed by the diagonal lines of the squares, the second set of sewing lines being formed by a plurality of spaced openings extending through the sheet.

3. The cutting and marking template of claim 1 wherein the diagonal lines of the squares form a continuous line extending from one side of the template to another.

4. A cutting and marking template for use in forming a plurality of middle split diagonal pieces for quilting comprising:

a generally flat sheet of transparent or semi-transparent material, a first polygon figure on the sheet formed by a plurality of cut lines formed by a plurality of spaced apart openings extending through the sheet, a plurality of sewing lines forming a second polygon having the same number of sides on the first polygon and formed within the perimeter of the first polygon; and a plurality of cut lines extending within the second polygon in the sheet, the cut lines being formed by a plurality of spaced apart openings extending through the sheet.

5. A cutting and marking template including a second template as claimed in claim 4 formed on the sheet and the polygon of the second template having a common side with the polygon of the first template.

6. A cutting and marking template for forming a plurality of length wise split diamond pieces for quilting comprising:

a generally flat sheet of transparent or semi-transparent material, a plurality of cutting lines forming a plurality of parallelograms having common side portions; and a plurality of straight, parallel sewing lines extending from one side of the template to the other whereby after sewing along the sewing lines and cutting along the sewing lines and cutting lines, a plurality of length wise split diamond pieces of quilting fabric are formed.

7. A cutting and marking template according to claim 6 wherein one of the horizontal cut lines is positioned between two horizontal sewing lines.

8. A cutting and marking template for forming a plurality of maple leaf stem block pieces for quilting patterns comprising:

a generally flat sheet of transparent or semi-transparent sheet material, have a top, bottom and side edges; and a first plurality of squares imprinted on the sheet, each square having a first common right angle section, and a pair of lines corresponding to the width of a stein portion of the maple leaf stem block extending diagonally across the template, one line or either side of a diagonal line extending through the squares.

9. A cutting and marking template according to claim 8 including:

a second plurality of squares imprinted on the board and each having a second common right angle section different from the first common right angle section.

* * * * *